US005620668A

United States Patent [19]

Driscoll et al.

[11] Patent Number: 5,620,668

[45] Date of Patent: Apr. 15, 1997

[54] ANNULAR AIR DISTRIBUTOR FOR REGENERATIVE THERMAL OXIDIZERS

[75] Inventors: Thomas D. Driscoll; James T. Gallo, both of Greenbay; Michael P. Loos, New Franken; David L. Petersen, Greenbay, all of Wis.

[73] Assignee: W.R. Grace & Co.-Conn., New York, N.Y.

[21] Appl. No.: 597,319

[22] Filed: Feb. 6, 1996

Related U.S. Application Data

[63] Continuation of Ser. No. 291,653, Aug. 17, 1994, abandoned.

[51] Int. Cl.[6] ..... F01N 3/10

[52] U.S. Cl. ..... 422/175; 422/170; 422/171; 422/173; 422/176; 422/182; 422/239; 431/5; 432/181; 432/182; 110/211

[58] Field of Search ..... 422/171, 170, 422/173, 172, 175, 176, 182, 198, 239; 431/5, 7, 170; 432/181, 182; 110/245, 345, 211, 212, 203; 34/576, 589

[56] References Cited

U.S. PATENT DOCUMENTS

| | | | |
|---|---|---|---|
| 3,451,783 | 6/1969 | Collins | 422/111 |
| 3,895,918 | 7/1975 | Mueller | 422/175 |
| 4,135,885 | 1/1979 | Wormser et al. | 422/176 |
| 4,290,785 | 9/1981 | Alldredge | 422/239 |
| 4,302,426 | 11/1981 | Benedick | 422/173 |
| 4,328,368 | 5/1982 | Salloum et al. | 422/239 |
| 4,335,076 | 6/1982 | McFarland | 422/171 |
| 4,426,360 | 11/1984 | Benedick | 422/173 |
| 4,474,118 | 10/1984 | Benedick | 110/211 |
| 4,802,423 | 2/1989 | Pennington | 110/233 |
| 5,024,817 | 6/1991 | Mattison | 422/175 |
| 5,054,208 | 10/1991 | Gillette et al. | 34/576 |
| 5,068,979 | 12/1991 | Wireman et al. | 34/58 |
| 5,101,741 | 4/1992 | Gross et al. | 110/233 |
| 5,149,259 | 9/1992 | Greco | 431/5 |
| 5,221,522 | 6/1993 | Cash | 422/171 |
| 5,259,757 | 11/1993 | Plejdrup et al. | 432/181 |
| 5,376,340 | 12/1994 | Bayer et al. | 422/175 |
| 5,417,927 | 5/1995 | Houston | 422/171 |
| B1 3,870,474 | 4/1991 | Houston | 422/171 |

FOREIGN PATENT DOCUMENTS 2037864 9/1991 Canada .

*Primary Examiner*—Robert J. Warden
*Assistant Examiner*—Hien Tran
*Attorney, Agent, or Firm*—Craig K. Leon; William L. Baker; Kevin S. Lemack

[57] ABSTRACT

A regenerative thermal oxidizer in which contaminated air is first passed through a hot heat-exchange bed and into a communicating high temperature oxidation (combustion) chamber, and then through a relatively cool second heat exchange bed. The apparatus includes a number of internally insulated, ceramic filled heat recovery columns topped by an internally insulated combustion chamber. Process air is directed into heat exchange media in one of said columns via an annular distribution system, which allows for the uniform flow of gas in the apparatus, and greatly reduces the flushing volume. Oxidation is completed as the flow passes through the combustion chamber, where one or more burners are located. From the combustion chamber, the air flows vertically downward through another column containing heat exchange media, thereby storing heat in the media for use in a subsequent inlet cycle when the flow control valves reverse. The resulting clean air is directed via an outlet valve through an outlet manifold and released to atmosphere or is recirculated back to the oxidizer inlet. The flushing system allows for the removal of residual VOC laden air from the plenum and heat exchange media and is critical for maintaining high VOC destruction efficiency.

10 Claims, 8 Drawing Sheets

ANNULAR AIR DISTRIBUTOR FOR REGENERATIVE THERMAL OXIDIZERS

This is a continuation of application Ser. No. 08/291,653, filed on Aug. 17, 1994, now abandoned.

BACKGROUND OF THE INVENTION

The control and/or elimination of undesirable impurities and by-products from various manufacturing operations has gained considerable importance in view of the potential pollution such impurities and by-products may generate. One conventional approach for eliminating or at least reducing these pollutants is by oxidizing them via incineration. Incineration occurs when contaminated air containing sufficient oxygen is heated to a temperature high enough and for a sufficient length of time to convert the undesired compounds into harmless gases such as carbon dioxide and water vapor.

In view of the high cost of the fuel necessary to generate the required heat for incineration, it is advantageous to recover as much of the heat as possible. To that end, U.S. Pat. No. 3,870,474 (the disclosure of which is herein incorporated by reference) discloses a thermal regenerative oxidizer comprising three regenerators, two of which are in operation at any given time while the third receives a small purge of purified air to force out any untreated or contaminated air therefrom and discharges it into a combustion chamber where the contaminants are oxidized. Upon completion of a first cycle, the flow of contaminated air is reversed through the regenerator from which the purified air was previously discharged, in order to preheat the contaminated air during passage through the regenerator prior to its introduction into the combustion chamber. In this way, heat recovery is achieved.

U.S. Pat. No. 3,895,918 (the disclosure of which is herein incorporated by reference) discloses a thermal regeneration system in which a plurality of spaced, non-parallel heat-exchange beds are disposed toward the periphery of a central, high-temperature chamber. Exhaust gases from industrial processes are supplied to these beds, which are filled with heat-exchanging ceramic elements. Conventionally, the cold face of a regenerative oxidizer is constructed of a flat perforated plate supported by structural steel. The structural steel has typically been modified to allow air flow through the exchange bed, but the obstruction caused by the structural steel reduces the air flow uniformity through the exchange bed. Also, the flat perforated plate and structural steel must support the weight of the heat exchange media, and are subject to failure. This arrangement also creates a large volume below the heat exchange media which must be flushed before flow through the columns can be reversed.

It is therefore an object of the present invention to reduce or eliminate the weight bearing design of the cold face of a regenerative oxidizer, promote more uniform distribution of air, reduce the volume to be flushed and improve the effectiveness of the flushing.

SUMMARY OF THE INVENTION

The problems of the prior art have been solved by the present invention, which provides a regenerative thermal oxidizer in which a gas such as contaminated air is first passed through a hot heat-exchange bed and into a communicating high temperature oxidation (combustion) chamber, and then through a relatively cool second heat exchange bed. The apparatus includes a number of internally insulated, ceramic filled heat recovery columns topped by an internally insulated combustion chamber. Process air is fed into the oxidizer through an inlet manifold containing a number of hydraulically operated flow control valves. The air is then directed into the heat exchange media via an annular distribution system. The heat exchange media contains "stored" heat from the previous recovery cycle. As a result, the process air is heated to near oxidation temperatures. Oxidation is completed as the flow passes through the combustion chamber, where one or more burners are located. The gas is maintained at the operating temperature for an amount of time sufficient for completing destruction of the VOC's. Heat released during the oxidation process acts as a fuel to reduce the required burner output. From the combustion chamber, the air flows vertically downward through another column containing heat exchange media, thereby storing heat in the media for use in a subsequent inlet cycle when the flow control valves reverse. The resulting clean air is directed via an outlet valve through an outlet manifold and released to atmosphere at a slightly higher temperature than inlet, or is recirculated back to the oxidizer inlet. An annular feed system allows for the uniform flow of gas in the apparatus, eliminates the need for structural cold face supports, and greatly reduces the flushing volume. The flushing system allows for the removal of residual VOC laden air from the valve plenum, annular air gap and heat exchange media and is critical for maintaining high VOC destruction efficiency.

DETAILED DESCRIPTION OF THE INVENTION

Preferably the thermal oxidizer regenerative system of the present invention consists of three regenerative columns. As larger units are required to handle larger feed stream volumes, the number of columns can be increased in multiples of two. Preferably no more than seven columns are used per combustion chamber; in the event the feed stream volume is too large for a seven column system, an additional system (with a combustion chamber) can be added and used in conjunction with the first system to meet the requirements.

Figure 1:
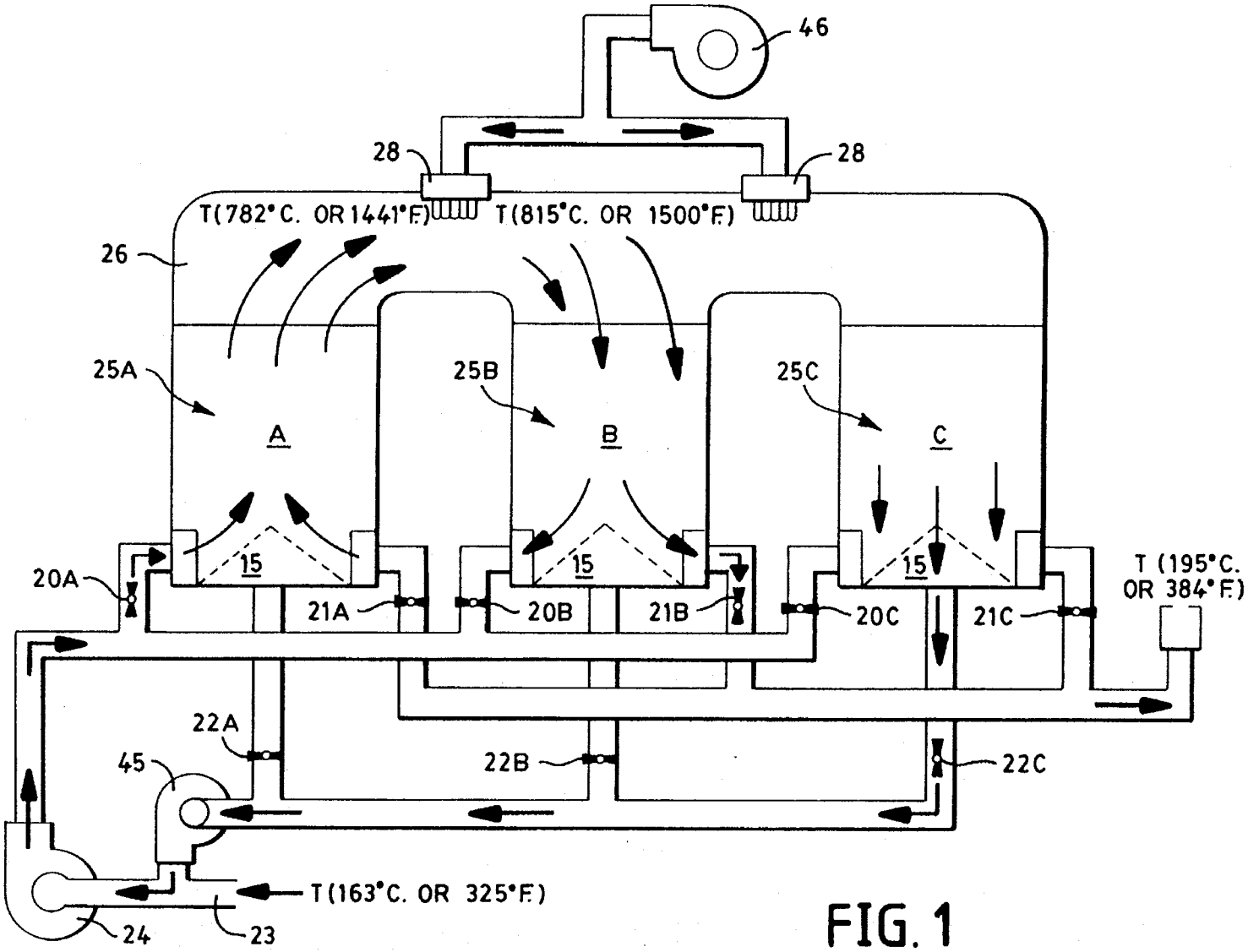
FIG. 1 is a schematic representation of the start of a total flow cycle through the regenerative apparatus of the present invention.
Figure 2:
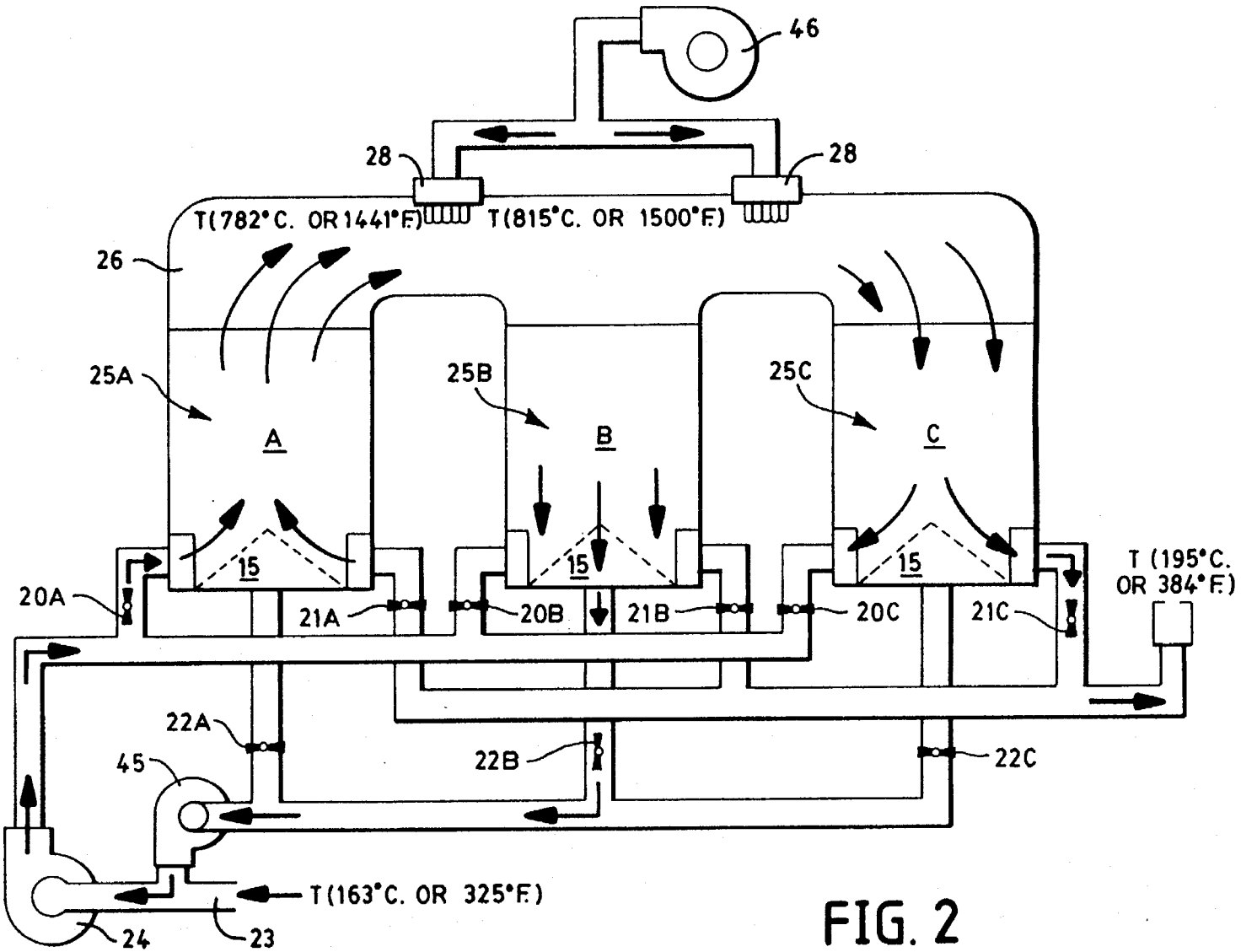
FIG. 2 is a schematic representation of step 2 of a total flow cycle through the regenerative apparatus of the present invention.
Figure 3:
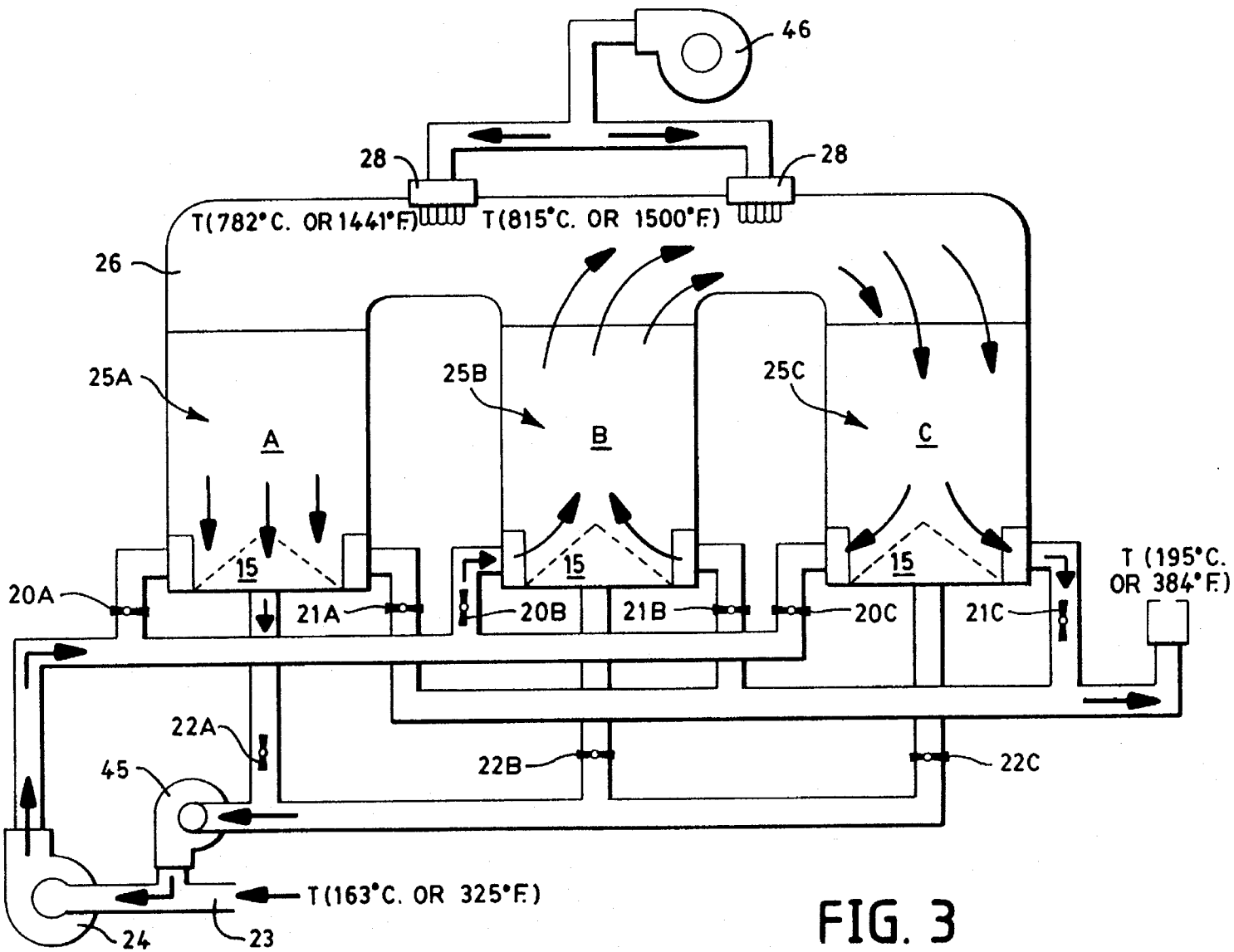
FIG. 3 is a schematic representation of step 3 of a total flow cycle through the regenerative apparatus of the present invention.
Figure 4:
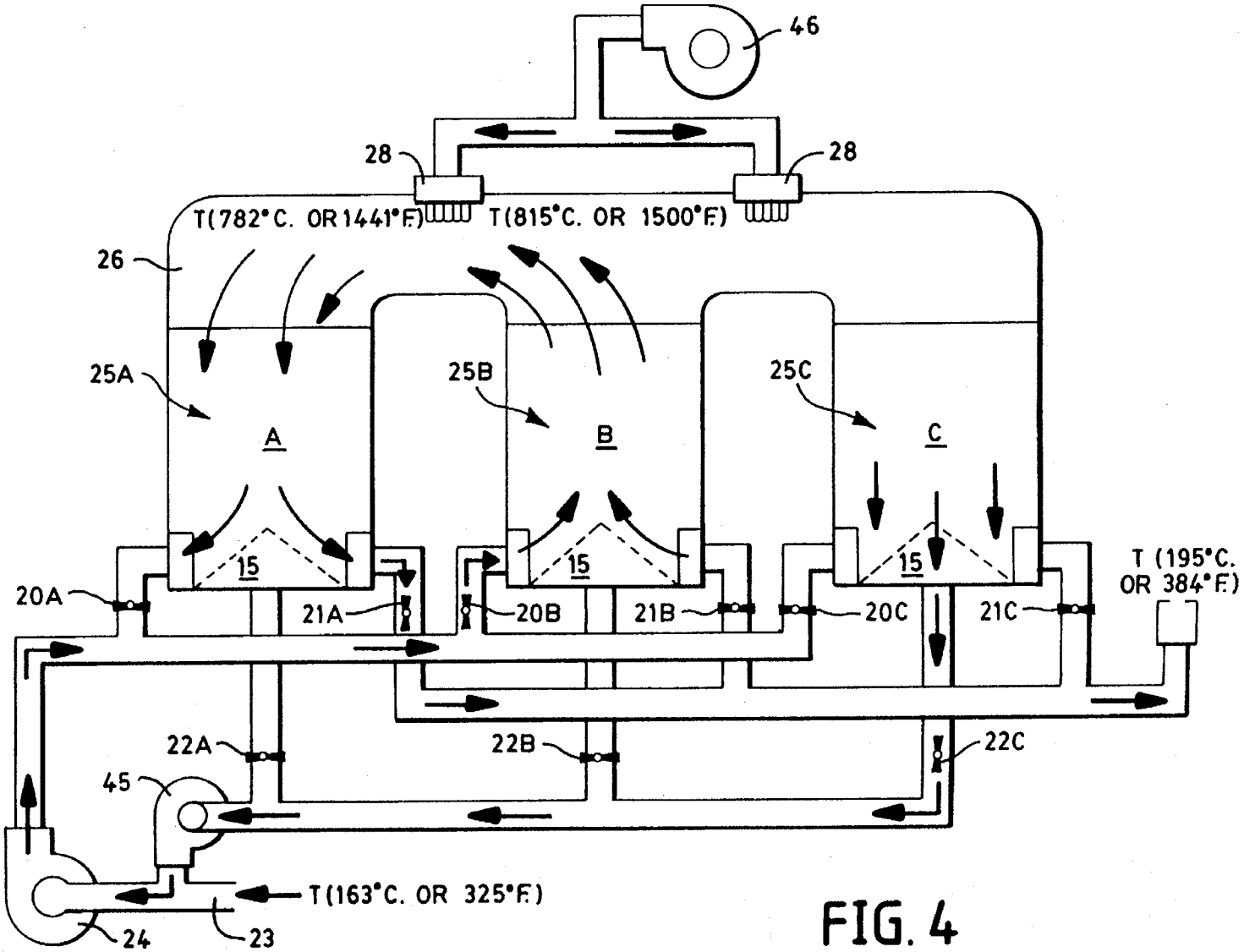
FIG. 4 is a schematic representation of step 4 of a total flow cycle through the regenerative apparatus of the present invention.
Figure 5:
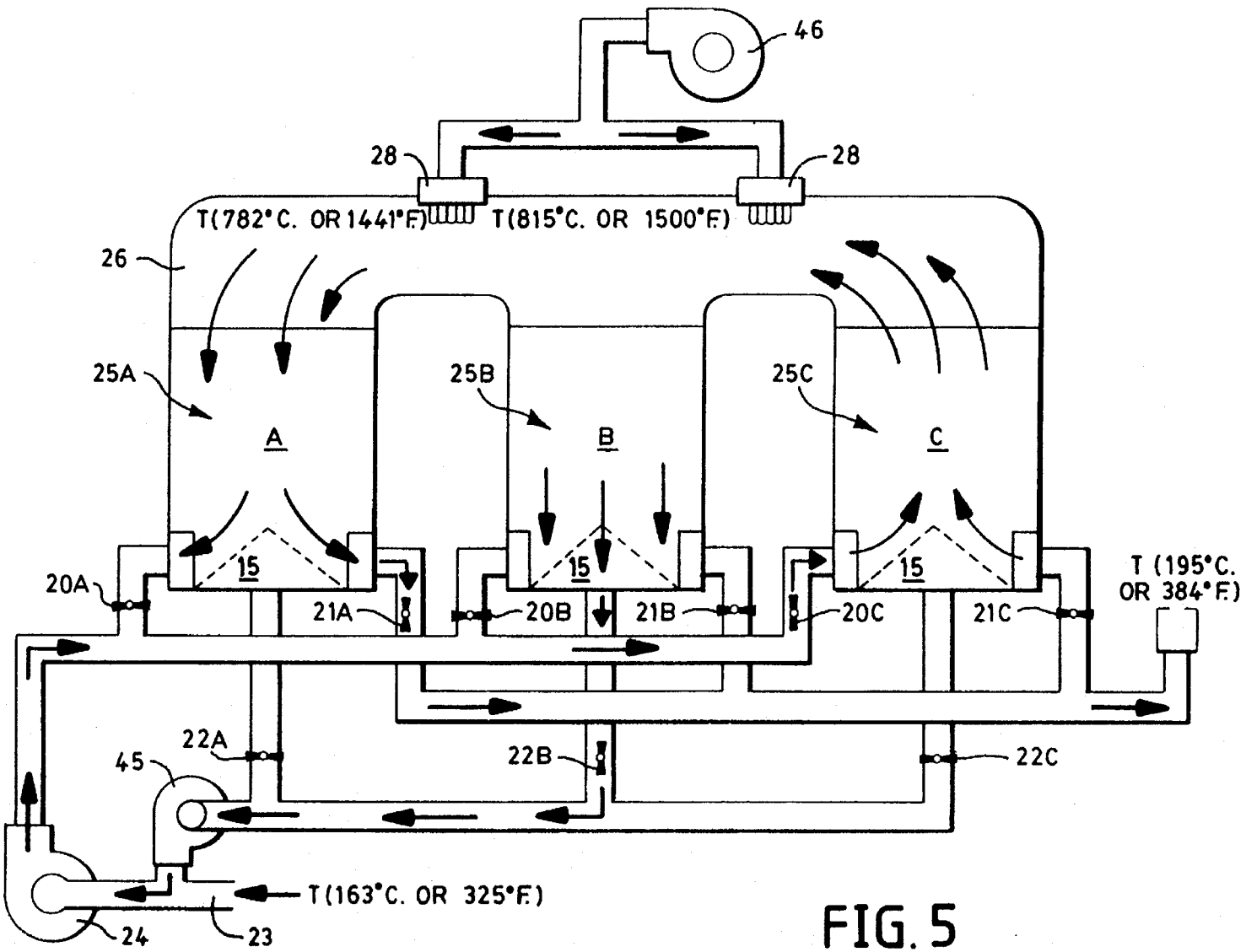
FIG. 5 is a schematic representation of step 5 of a total flow cycle through the regenerative apparatus of the present invention.
Figure 6:
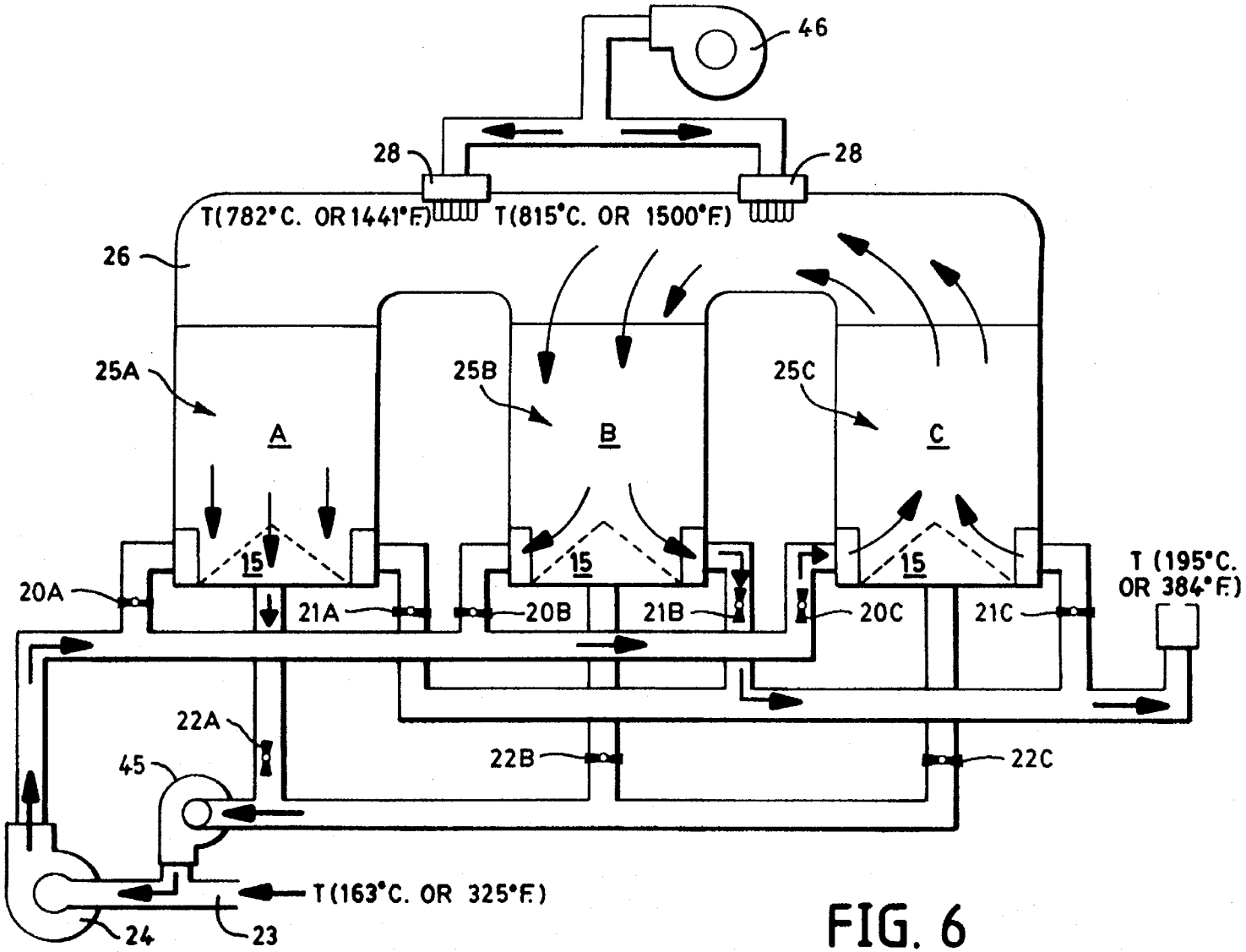
FIG. 6 is a schematic representation of the final step of a total flow cycle through the regenerative apparatus of the present invention.
Figure 8:
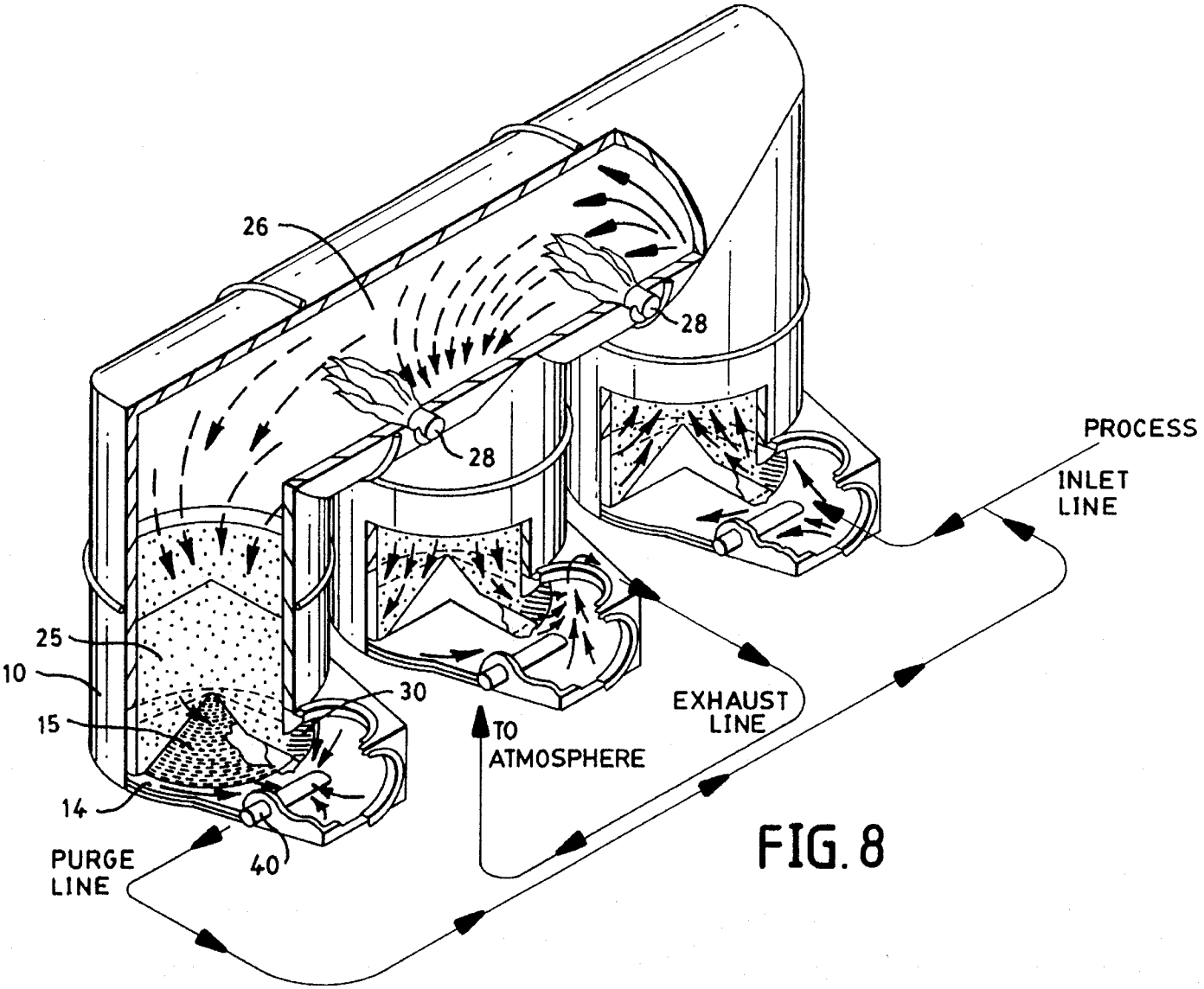
FIG. 8 is an isometric view, partially cutaway, of the regenerative apparatus of the present invention.

The flow through the regenerative device of the present invention is illustrated in FIGS. 1 through 6. These cutaway illustrations represent elevation views of the three columns, the combustion chamber, the inlet header, the outlet header and the flushing header. At some arbitrary time T(0), FIG. 1 represents the flow path through the oxidizer. Column A is on an inlet or gas heating cycle (i.e., the inlet valve 20A is open, and the outlet valve 21A and flushing valve 22A are closed). Contaminated air 23 enters the base of regenerative column A by passing through the exhaust fan 24, inlet manifold, and inlet valve 20A. It is then distributed annularly around the base of the column of heat exchange media or ceramic media 25A and enters the media through a perforated basket 16, and is passed vertically up through the ceramic media 25A and removes stored heat from the media 25A in column A so that by the time it enters the combustion chamber 26, it has been heated to almost the operating temperature. Fan 24 feeding the inlet of the oxidizer is a variable speed fan, and is located so as to create a forced draft system, rather than the conventional induced draft system used in prior art apparatus. The forced draft system places the fan in the cooler inlet stream, and as a result, a smaller fan can be used. The forced draft fan also acts as a buffer to reduce the effects of valve induced pressure fluctuations on the upstream process. One or more burners 28 in the combustion chamber (FIG. 8) provide heat to raise the air temperature. A combustion blower fan 46 is provided, which supplies combustion air for the operation of the burners. Its flow is modulated by dampers in the combustion air piping so as to vary the firing rate of the burners. The contaminated air is held at the combustion temperature for approximately one second. It then enters column B, which is on its outlet or gas cooling cycle (i.e., the outlet valve 21B is open, and the inlet valve 20B and flushing valve 22B are closed). As the air passes vertically down through the ceramic media 25B, heat is stored in the media such that by the time the air exits the oxidizer, it has been cooled to a temperature slightly hotter than the inlet temperature. The hydraulically driven valves continuously cycle, causing heat to be removed from the ceramic media in one column and stored in the ceramic media in another column.

In FIG. 1, column C is in a flushing cycle (i.e., the flushing valve 22C is open, the inlet valve 20C and the outlet valve 21C are closed). In this mode, a small quantity of air is drawn from the valve plenum, annular air space, and ceramic media and returned to the inlet manifold (line 23) so that contaminated air remaining in the valve plenum, ceramic media 25C and annular air space surrounding the ceramic media 25C can be returned to the inlet manifold and oxidized through a column which is on an inlet cycle (i.e., column A in the cycle shown). Without this feature, a small amount of unoxidized contaminants would be released to atmosphere every time a regenerative column transitions from an inlet mode to an outlet mode, making it impossible to obtain 99% destruction of all VOC's. The flushing cycle is only necessary when a column is transitioning from an inlet mode to an outlet mode. However, as can be seen in FIGS. 1 through 6, the flushing valve opens whenever a column is transitioning. This is done to maintain constant flow and therefore reduce pressure fluctuations in the process exhaust stream. A flushing fan 45 having a manual damper on its inlet or discharge which is set during start-up ensures constant flushing volume under all flow conditions.

FIGS. 2–6 illustrate the remaining steps in the total cycle. A total cycle is defined as the amount of time to complete all six (6) steps. The typical total cycle time for a three column regenerative thermal oxidizer is 4.5 minutes. Table 1 shows the positions of the valves in a three-column unit for each step of the total cycle shown in FIGS. 1–6.

TABLE 1

VALVE SEQUENCE FOR 3 CANNISTER REGEN UNIT

| | CANNISTER NUMBER | | | | | | | | |
|---|---|---|---|---|---|---|---|---|---|
| | 1 | | | 2 | | | 3 | | |
| TIME | INLET VALVE POSITION | OUTLET VALVE POSITION | FLUSHING VALVE POSITION | INLET VALVE POSITION | OUTLET VALVE POSITION | FLUSHING VALVE POSITION | INLET VALVE POSITION | OUTLET VALVE POSITION | FLUSHING VALVE POSITION |
| 0 | OPEN | CLOSED | CLOSED | CLOSED | OPEN | CLOSED | CLOSED | CLOSED | OPEN |
| 45 | OPEN | CLOSED | CLOSED | CLOSED | CLOSED | OPEN | CLOSED | OPEN | CLOSED |
| 90 | CLOSED | CLOSED | OPEN | OPEN | CLOSED | CLOSED | CLOSED | OPEN | CLOSED |
| 135 | CLOSED | OPEN | CLOSED | OPEN | CLOSED | CLOSED | CLOSED | CLOSED | OPEN |
| 180 | CLOSED | OPEN | CLOSED | CLOSED | CLOSED | OPEN | OPEN | CLOSED | CLOSED |
| 225 | CLOSED | CLOSED | OPEN | CLOSED | OPEN | CLOSED | OPEN | CLOSED | CLOSED |
| **270 | OPEN | CLOSED | CLOSED | CLOSED | OPEN | CLOSED | CLOSED | CLOSED | OPEN |

**NOTE: THIS IS A REPEAT OF STEP NO.1 OR TIME 0.

Figure 7:
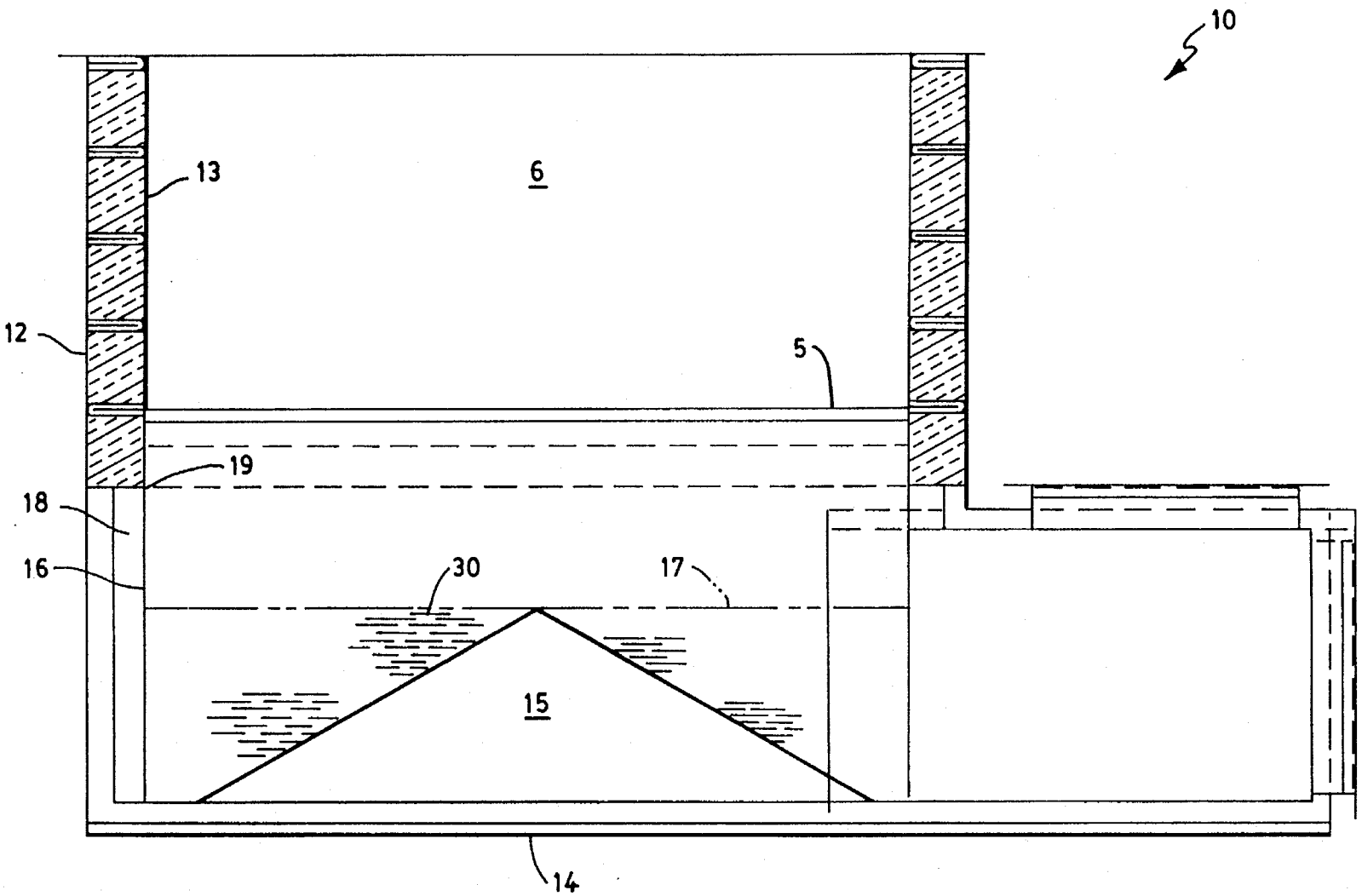
FIG. 7 is a cross-sectional view of the regenerative column assembly in accordance with the present invention.

Turning now to FIG. 7, there is shown a typical regenerative column assembly generally at 10. The column shown is representative of the other columns that are used in the system, which can number two, three or more. The assembly 10 is defined by a thermally insulated cylindrical outside shell 12, preferably insulated with ceramic fiber insulation 13. The cylindrical shell 12 has an insulated bottom member 14. A perforated cone 15 is housed at the lower end of the cylindrical column assembly 10 for purposes to be described below.

Inside column 10 at the base thereof is a partially perforated cylindrical cold face basket 16, which can be made of stainless steel. The perforations 30 in basket 16 extend up from the bottom edge of the basket until phantom line 17. The remainder of the cylindrical basket 16 above phantom line 17 is solid, i.e., it is devoid of perforations. The bottom of the basket 16 is formed by an annular flat plate and the perforated cone 15. Preferably, the perforations 30 in the basket 16 yield approximately 53% open area on a square foot basis. The total open area of the perforations 30 in the basket 16 is equal to about 50% of the cross-sectional area of the column inside of the insulation 13. The outside diameter of the cylindrical basket 16 is slightly smaller than the inside diameter of column 10, less twice the insulation thickness 13. An annular gap 18 of between 5" and 9" deep (depending upon the size of the oxidizer) is formed by varying the insulation thickness above and below the non-perforated section of the basket 16. The height of the annular gap 18 will vary depending upon the size of the outlet valve, but should generally be about equal to the diameter of the outlet valve plus 12". The annular gap 18 is closed off at 19 near the top of the perforated section of the cylindrical basket 16 by the change in insulation thickness, as well as by a cold face annular basket cap 5. The basket cap 5 is held in place by the insulation 13 of column 10, and extends just over the lip at the top of basket 16 so as to block any flow of air from bypassing the ceramic media. The cap 5 also prevents heat exchange media from falling between the outside diameter of the basket 16 and the inside diameter of the insulation 13, while allowing for thermal expansion of the basket 16.

The cylindrical basket 16 contains the heat exchange media 25 (FIG. 8), which is supported by the base 14 of the column 10, and ultimately by the concrete foundation on which the apparatus rests. As a result, there are no heat exchange media structural supports which have conventionally been prone to failure due to the weight of the media. The absence of such structural supports also eliminates the obstruction in air flow caused by such supports, and the increased volume of air that was necessary during a flushing cycle. The heat exchange media 25 is preferably piled higher than the basket 16 so as to extend into the upper portion 6 of the column 10. Any suitable heat exchange media that can sufficiently absorb and store heat can be used. Preferably, the heat-exchange media 25 is made of a ceramic refractory material having a saddle shape or other shape designed to maximize the available solid-gas interface area.

As VOC laden gas enters the base of a regenerative column 10 that is on an inlet (gas heating) cycle, it is uniformly distributed about annular gap 18 and passes through the perforations 30 in the basket 16 until it fills the entire void volume within the column. This annular feed system causes a more even distribution of the air into the ceramic media than is otherwise achieved.

Although the process gas inlet to each column 10 is located near the base 14, there is the potential for an unused volume of heat exchange media at the bottom center of the bed. In order to eliminate this possibility, a perforated cone 15 (suitably made of stainless steel) is located at the base of the bed to fill this volume. The base of the cone 15 is about 12" smaller in diameter than the inside diameter of the basket 16. The elevation of the cone is about 30° from the horizontal. The perforated cone 15 supports the heat exchange media 25, and preferably no heat exchange media is placed under the cone 15.

The perforations in the cone 15 are used in conjunction with the flushing of the annular air gap 18, valve plenum and heat exchange media 25 during a flushing cycle. Air is extracted from the annular air gap 18, around the basket 16, the valve plenum and from within voids or interstices of the heat exchange media 25 via the perforated cone 15. To this end, a separate flushing manifold or ducting containing a flushing fan 45 and a number of flow control valves, connects the outlet of this fan 45 to the inlet of the oxidizer exhaust fan 24 and the inlet of this fan 45 to the flow control valves which are mounted on connections at the base of each valve plenum. Inside the valve plenum, a perforated pipe 40 joins the valve to the cone 15 such that when inlet valve 20A and outlet valve 21A are closed, the flushing valve 22A on that column will open, and VOC laden air is drawn from the valve plenum, the annular gap 18 around the basket 16, and from within the cone 15, which allows air to be drawn from within the heat exchange media 25 and returned to the inlet manifold and ducted into a regenerative column which is on an inlet cycle. The annular air distribution results in a decreased volume at the base of the heat exchange media, which in turn results in a smaller flushing volume. Those skilled in the art will be able to readily determine the number, geometry and size of the perforations on the pipe 40 and the cone 15 to allow for the optimal amount of air to be drawn from the various areas within the base of the column, which will depend upon the particular requirements of a given job. For example, 12 mm holes distributed to allow 20% of the flushing air to be drawn from the annular gap 18, 60% of the flushing air to be drawn from the cone 15 and therefore from the heat exchange media 25, and 20% of the flushing air to be drawn from the valve plenum, have been found to be suitable. Those skilled in the art will further recognize that the relative amounts of flushing air to be drawn from these areas can be varied by varying the number, geometry and/or size of the perforations.

Since the fan 24 feeds the inlet of the oxidizer, the regenerative thermal oxidizer of the present invention utilizes a "forced draft" system rather than the conventional "induced draft" system where the fan is located at the oxidizer exhaust. The forced draft system places the fan in the cooler inlet stream, resulting in a smaller fan. An additional benefit is that the forced draft fan acts as a "buffer" to reduce the effects of valve-induced pressure fluctuations on the upstream process.

The regenerative apparatus of the present invention can handle almost all size requirements, from about 4000 SCFM to about 100,000 SCFM, by employing additional columns. Applications requiring larger than 100,000 SCFM can be handled with multiple units.

By varying the amount of heat exchange media contained in the columns, thermal efficiencies (T.E.'s) of 85%, 90% or 95% can be obtained. For example, an 85% T.E. unit will have an approximate heat exchange media bed depth of three feet; a 90% T.E. unit will have a six foot bed depth, and a 95% T.E. unit will have an eight foot bed depth. Standard operating temperatures of 1500° F. are preferred, although design temperature of 1800°–2000° F. or higher can be accommodated.

What is claimed is:

1. A regenerative oxidizer system for purifying a gas, comprising:

a combustion chamber for oxidizing constituents of a VOC laden gas to be decontaminated and a plurality of regenerator columns each having an upper portion in communication with said combustion chamber and having a base and an inside diameter containing heat exchange media operative to absorb and store heat from the VOC laden gas to be decontaminated, said combustion chamber in communication with said upper portion of each of said regenerator columns to permit the gas to flow in one of said columns in a first direction and through another of said columns in a second direction;

a cylindrical basket contained in said base of each of said regenerator columns for supporting the heat exchange media therein, each basket having a bottom and cylindrical outer diameter smaller than said inside diameter of said column base whereby an annular gap is defined around said basket a portion of said cylindrical basket adjacent to said column base being perforated to permit the gas to flow therethrough the bottom of said basket comprising a perforated cone for supporting the heat exchange media in said basket and defining a volume beneath the heat exchange media supported in said basket, said perforated cone having a base smaller than the inside diameter of said regenerator column base;

gas inlet and outlet means communicating with each of said annular gaps in the bases of each of said regenerator columns;

first valve means associated with said gas inlet and outlet means for alternately directing the gas into one of said columns in a first direction and through another of said columns in a second direction, said first valve means communicating with said annular gaps whereby the gas is introduced into and removed from said columns; and second valve means coupled to said volume defined beneath said perforated cones, said second valve means operative to control gas flow out of said columns through said volume beneath said perforated cones.

2. The system of claim 1 wherein said baskets comprise stainless steel and a portion of said cylindrical basket is unperforated.

3. The system of claim 2 wherein each of said baskets comprises a bottom formed by an annular flat plate and said perforated cone.

4. The system of claim 2 wherein said heat exchange media comprises ceramic material.

5. The system of claim 4 wherein said volume defined beneath said perforated cone is devoid of heat exchange media.

6. The system of claim 4 wherein said heat exchange media is piled higher than said basket.

7. The system of claim 1 wherein said plurality of regenerator columns comprises at least three regenerator columns and first and second valving means are arranged whereby gas flows in a first direction through one of said columns; gas flows through a second direction in a second of said columns; and gas is flushed out of a third of said columns through said second valve means coupled to said volume defined beneath said perforated cones.

8. A process for combusting contaminated gas comprising:

providing a combustion chamber for oxidizing constituents of gas to be decontaminated and a plurality of regenerator columns each having an upper portion in communication with said combustion chamber and having a base and an inside diameter containing heat exchange media operative to absorb and store heat from the gas to be decontaminated, said combustion chamber communicating with said upper portion of each of said regenerator columns to permit the gas to flow in one of said columns in a first direction and through another of said columns in a second direction;

providing a basket contained in said base of each of said regenerator columns for supporting the heat exchange media therein, each basket having a bottom and cylindrical outer diameter smaller than said inside diameter of said column base whereby an annular gap is defined around said basket, a portion of said cylindrical basket adjacent to said column base being perforated to permit the gas to flow therethrough the bottom of said basket comprising a perforated cone for supporting the heat exchange media in said basket and defining a volume beneath the heat exchange media supported in said basket, said perforated cone having a base smaller than the inside diameter of said regenerator column base;

providing gas inlet and outlet means communicating with each of said annular gaps in the bases of each of said regenerator columns;

providing first valve means associated with said gas inlet and outlet means for alternately directing the gas into one of said columns in a first direction and through another of said columns in a second direction, said first valve means communicating with said annular gaps whereby the gas is introduced into and removed from said columns; and providing second valve means coupled to said volume defined beneath said perforated cones, said second valve means operative to control gas flow out of said columns through said volume beneath said perforated cones.

9. The process of claim 8 wherein said plurality of regenerator columns comprises at least three regenerator columns and first and second valve means are arranged whereby gas flows in a first direction through one of said columns; gas flows through a second direction in a second of said columns; and gas flows out of a third of said columns through said second valve means coupled to said volume defined beneath said perforated cones.

10. The process of claim 9 comprising flushing gas out of one of said columns through said second valve means and recirculating it into another of said columns through said first valve means.

* * * * *